United States Patent [19]

Hancock

[11] Patent Number: 4,909,672

[45] Date of Patent: Mar. 20, 1990

[54] OFFSHORE STRUCTURE

[75] Inventor: Michael V. Hancock, Tiburon, Calif.

[73] Assignee: Earl and Wright, San Francisco, Calif.

[21] Appl. No.: 302,806

[22] Filed: Jan. 27, 1989

[30] Foreign Application Priority Data

Jan. 29, 1988 [GB] United Kingdom ..... 8801950

[51] Int. Cl.[4] ..... E02B 17/02

[52] U.S. Cl. ..... 405/227; 405/209

[58] Field of Search ..... 405/203, 205, 206, 209, 405/224, 227

[56] References Cited

U.S. PATENT DOCUMENTS 3,729,940 5/1973 Koehler ..... 405/227 X 3,859,804 1/1975 Koehler et al. ..... 405/209

4,683,832 8/1987 Dysarz ..... 405/209 X

*Primary Examiner*—David H. Corbin

*Attorney, Agent, or Firm*—Flehr, Hohbach, Test, Albritton & Herbert

[57] ABSTRACT

A lattice framework to form or when forming an offshore structure capable of supporting a deck above the water for offshore operations, such as drilling for oil or gas for exploration or production as well as radar stations and the like where it is desired to maintain a stable platform in a fixed position over the sea bed, having four main legs which branch out into buttresses to support a spread base at the lower part of the structure and in which two of the main legs form launch rails on which the structure can be launched from a barge.

3 Claims, 6 Drawing Sheets

OFFSHORE STRUCTURE

The invention relates to fixed platforms for use in offshore operations such as oil and gas exploration, drilling and production.

Various offshore platform designs and configurations have been developed. These prior designs consist, typically, of four-, six-, or eight-leg structures which extend from the seafloor up to a deck (supporting e.g. a drilling floor, wellhead floor or other platform above the water level). Four-leg structures are lift-installed or self-floating and, more recently, barge-launched, with a set of launch trusses in addition to the four legs (thereby effectively making them six-leg structures). Eight-leg structures for deep water are normally barge-launched. Examples of prior designs are shown in UK Patent Specifications 2133447 and 2165571.

The choice between a four-, six- or eight-leg structure is generally made based on the magnitude of deck load, and environmental criteria expected for the site where the platform is to be located. If a four-leg structure can satisfy these conditions it is normally the most efficient solution. Typically, a six-leg structure is chosen where the four corner legs are used primarily for in-place load resistance, with the two internal legs being provided for launching the structure from a barge. (See FIGS. 1 to 5 of UK 2133447). An eight-leg structure is typically designed for conditions where a large base and/or topsides are required and/or where loads are high. (See UK 2165571.)

It is an object of this invention to provide an improved barge-launched structure applicable in cases where four-, six-, or, more importantly, eight-leg structures have traditionally been required. It is also an object of this invention to provide a structure with relatively low foundation loads.

At a distance of approximately 40 percent of the height of the structure up from the base, the four-leg central core of the structure is supported on two sides by buttresses attached to a relatively shallow spread base. The base can be supported by a number of pile groups, such as one at each corner of the base and one under each of the four central core legs; in addition, provision may be made for piles to be attached to vertical posts between the above-mentioned legs. The piled foundation may consist of any type of piles, and permits the development of a balanced efficient load distribution between functional load and cyclic load while providing significant redundancy to the entire system.

While the spread base might branch out from the main legs at between 20% to 50% of the height of the structure above its base, it is expected that it would optimally branch out at between 30% to 45% of that height.

A feature of this invention is that the four legs branch out in the form of buttresses at approximately 40% of the height of the structure up from its base, in order to transfer load in a direct manner to corner pile groups. The buttresses thus provide a direct load path for loads in the upper portions of the four legs to be transferred to the extremities of the spread base. The buttresses serve also to stiffen the upper section of the four-leg structure and the extensions to the base.

Load in the legs can thus be transferred less by shearing forces through extended panels of the spread base than by direct load through the buttresses. In this manner the extended panels of the base do not have to have great depth to provide for transfer of load to the corners, and for stiffening the four-leg central core to resist dynamic loading.

A main feature of this invention, however, is that the relative stiffnesses of, and therefore proportions of load carried between, the buttresses and extended panels can be adjusted to provide a balance between location, size and angle of the buttresses, and depth and stiffness of the extended panels. It also permits loads to be proportioned between outer pile group loads and inner leg pile loads, or those at intermediate posts, particularly if dead load and cyclic load are to be proportioned.

Therefore, it is an object of this invention to provide the effect of a larger structure, in terms of load resistance at its base, while it is a four-leg structure at the upper level, where the most significant wave load occurs.

Although this is generally advantageous, it becomes of particular advantage in situations where the platform is to be located at a site having weak soil conditions, because the spread base minimizes the loads on the pile foundations, and load components at pile locations can be varied, by virtue of the buttresses. This invention becomes of even greater advantage in cases where sites having weak soil conditions also have severe environmental criteria. In such cases it is an object of this invention to provide a structure which attracts low wave loads (i.e. a narrow four-leg structure at the top) while providing an efficient foundation (i.e. a spread base at the bottom). This leads to reducing or minimising fabricated steel weight, and therefore fabrication cost.

Another object is to provide a structure of the type described of which components can be fabricated and assembled in a quick and easy manner, thereby reducing fabrication time, and therefore fabrication cost.

Another object is to provide a structure which can be transported and installed efficiently, by conventional methods. Because two of its four core legs are parallel, these two legs can also serve as launch legs, therefore dispensing with the need for an additional set of launch legs.

Because of the small and light upper part and heavy lower part of the structure, the center of gravity is low (as in overall launch weight). This results in an efficient launch. The structure skids down the barge and does not rotate until it is almost completely in the water. This results in relatively low forces applied to the structure during this operation. Following launch, because of the low center of gravity, the structure, assisted by auxiliary buoyancy tanks, self-upends to a vertical attitude. This eliminates the necessity of controlled upending procedures with expensive and sophisticated mechanical systems.

Another object is to provide efficiency and flexibility in the foundation and, because of the lower wave loading, a reduced number, or smaller, piles. Another object is to install the foundation without pile guides on the structure. Fixed offshore structures are typically supported on foundation piles. This invention allows for either vertical or battered piles of any type. The configuration allows for a choice of ways to attach piles to the structure. It allows for piles to be clustered in the corners and/or at internal legs as well as at vertical posts between internal and corner legs and, because of the buttresses, permits load to be proportioned between these pile locations. These requirements are site- and load-dependent, but the configuration allows for a great deal of flexibility.

In summary, the invention offers a cost-effective approach to an offshore platform's life-cycle requirements. The structure can be described as a four-leg barge-launched jacket with a buttressed base that is extended on two sides. The four legs extend over the top two-thirds of the structure and can be augmented by two auxiliary legs through the waterline, which act as deck supports and increase redundancy at the waterline. Two of the main legs are used for launching the structure. This is far more efficient than a four-leg barge-launched structure with internal launch rails.

The invention provides a lattice framework to form or when forming an offshore structure capable of supporting a deck above the water for offshore operations, such as drilling for oil or gas for exploration or production as well as radar stations and the like where it is desired to maintain a stable platform in a fixed position over the sea bed, having four main legs which branch out into buttresses to support a spread base at the lower part of the structure and in which two of the main legs form launch rails on which the structure can be launched from a barge.

It is preferred that the framework is arranged to accommodate any type of pile foundation in a vertical or battered manner attached to any of eight legs or at posts between those legs.

It is further preferred that the framework is arranged to permit leg loads to be adjusted between different pile or pile group locations.

It is still further preferred that the framework rotates when a rocker beam on the barge is near its bottom bay resulting in total rocker beam reactions being less than 45 percent of the structure launch weight.

Preferably the framework with the assistance of auxiliary buoyancy tanks can self-upend to the upright position following launch.

A specific embodiment and variants of the invention will now be described by way of example with reference to the accompanying drawings, in which.

Figure 1:
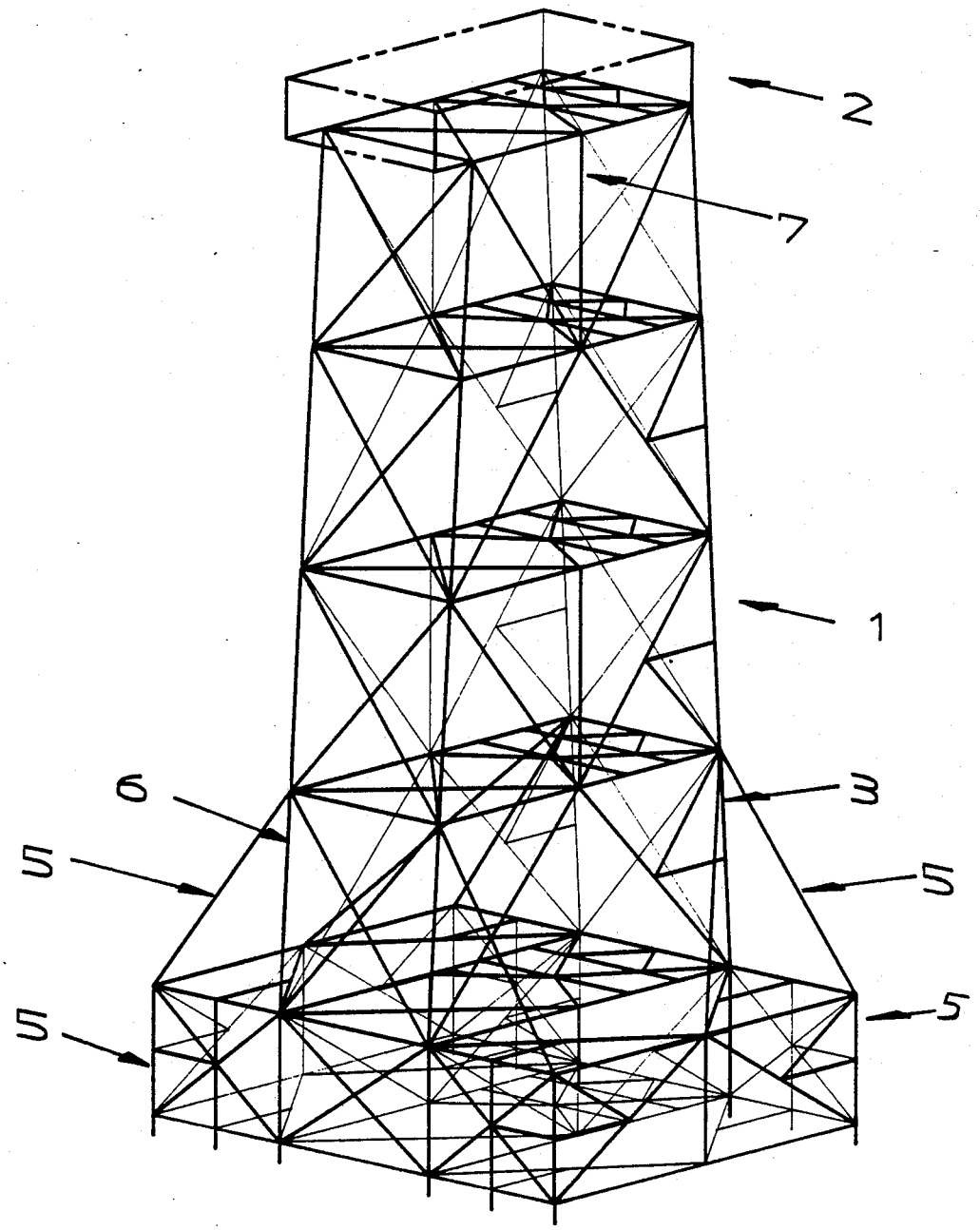
FIG. 1 is a perspective view of a structure (in computer model form) incorporating the present invention. It includes a typical module support frame at the top to support a deck.
Figure 2:
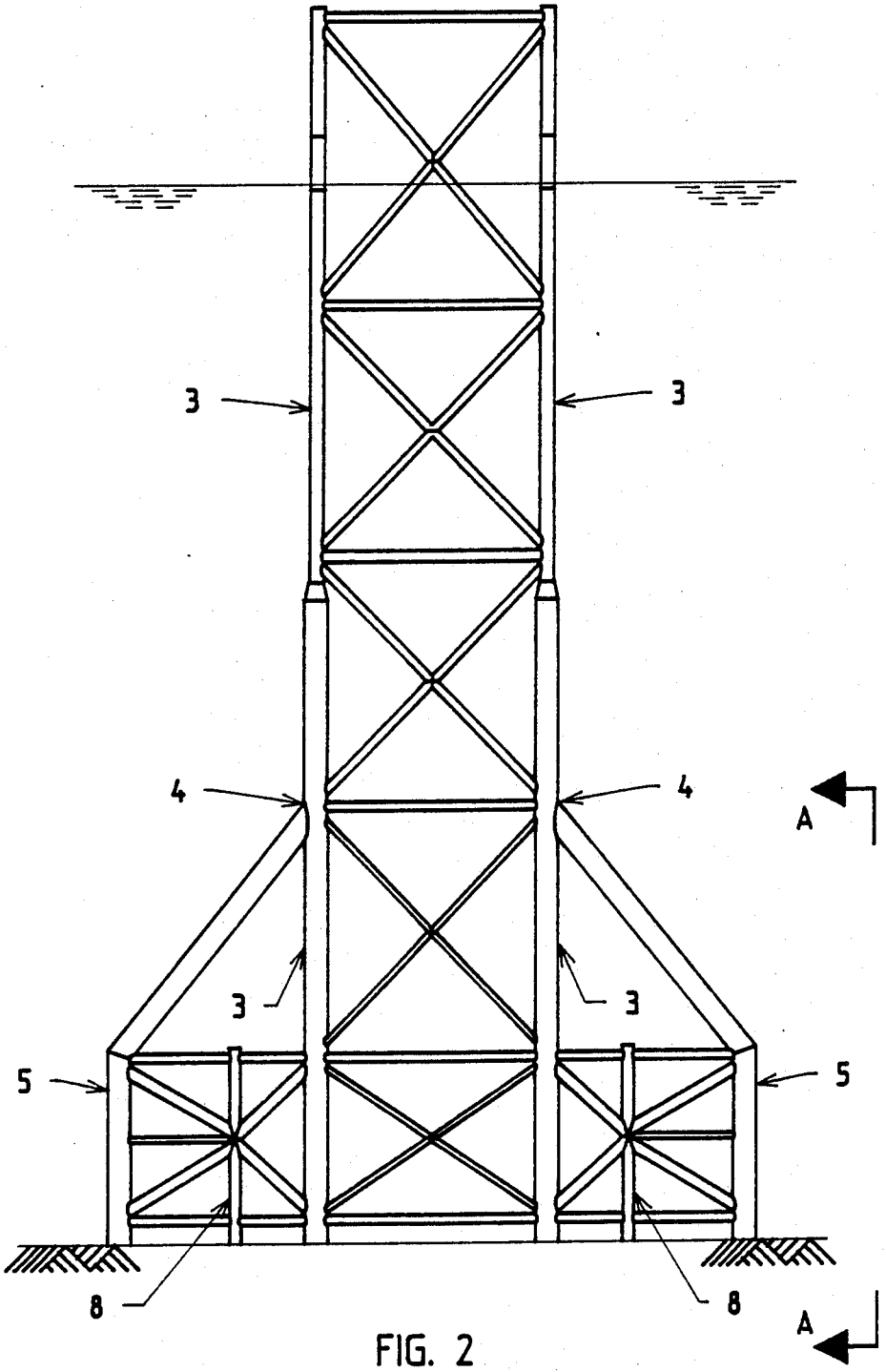
FIG. 2 is an elevational view of the structure of FIG. 1, without deck, showing the unit along extended panels and buttresses supporting the spread base.
Figure 3:
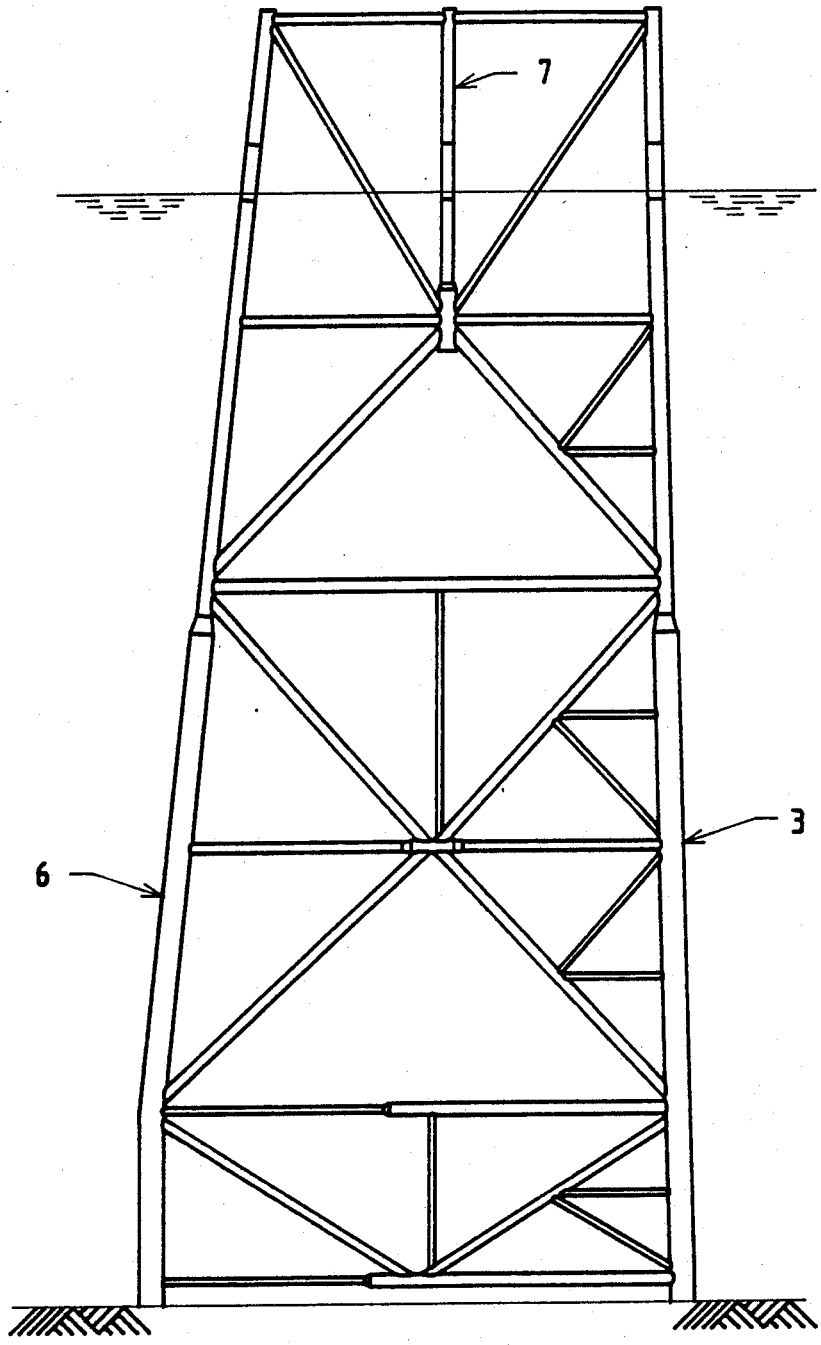
FIG. 3 is an elevational view of the structure, similar to FIG. 2, showing the unit along the launch frame.
Figure 4:
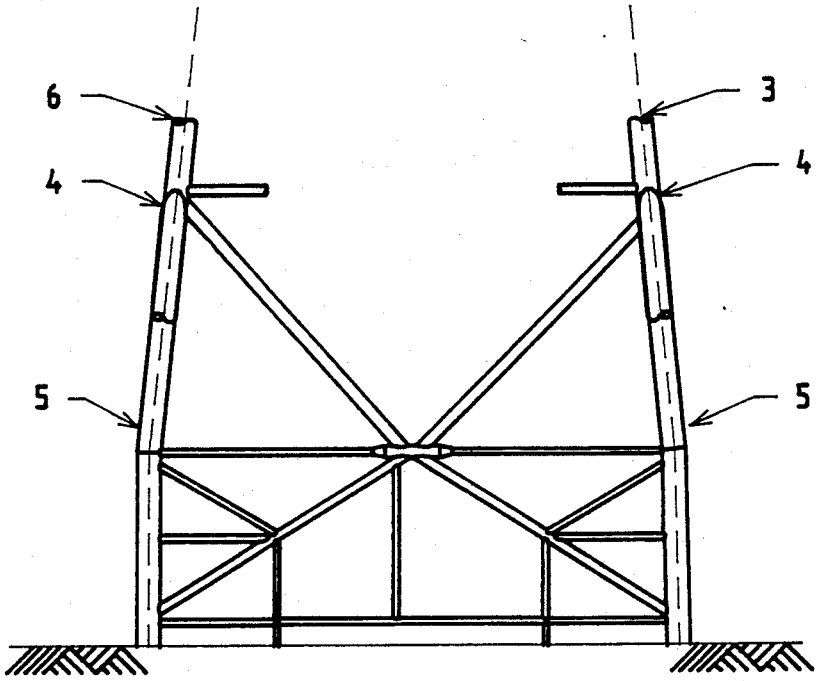
FIG. 4 is an elevational view taken along the line A—A of FIG. 2.

As shown in FIG. 1, a module support frame 1 of any configuration may be attached to the structure 2 presented in this invention to support a deck. Referring to FIGS. 2 and 3, two of the four legs 3 are used for launching the structure from a barge. The other two core legs 6 may or may not be kinked. The structure has six plan levels although this can vary depending on the specific height of the structure. At node 4, the four main legs branch out in the form of buttresses, to support extended panels of a spread base composed of eight legs designated 3 (two off), 5 (four off) and 6 (two off). At the top of the structure an auxiliary leg 7 may assist to support deck loads. At the bottom of the structure, between internal legs 3 and 6 and corner legs 5, additional posts 8 may be provided in the extended panels if piles are needed between the main legs.

Figure 5:
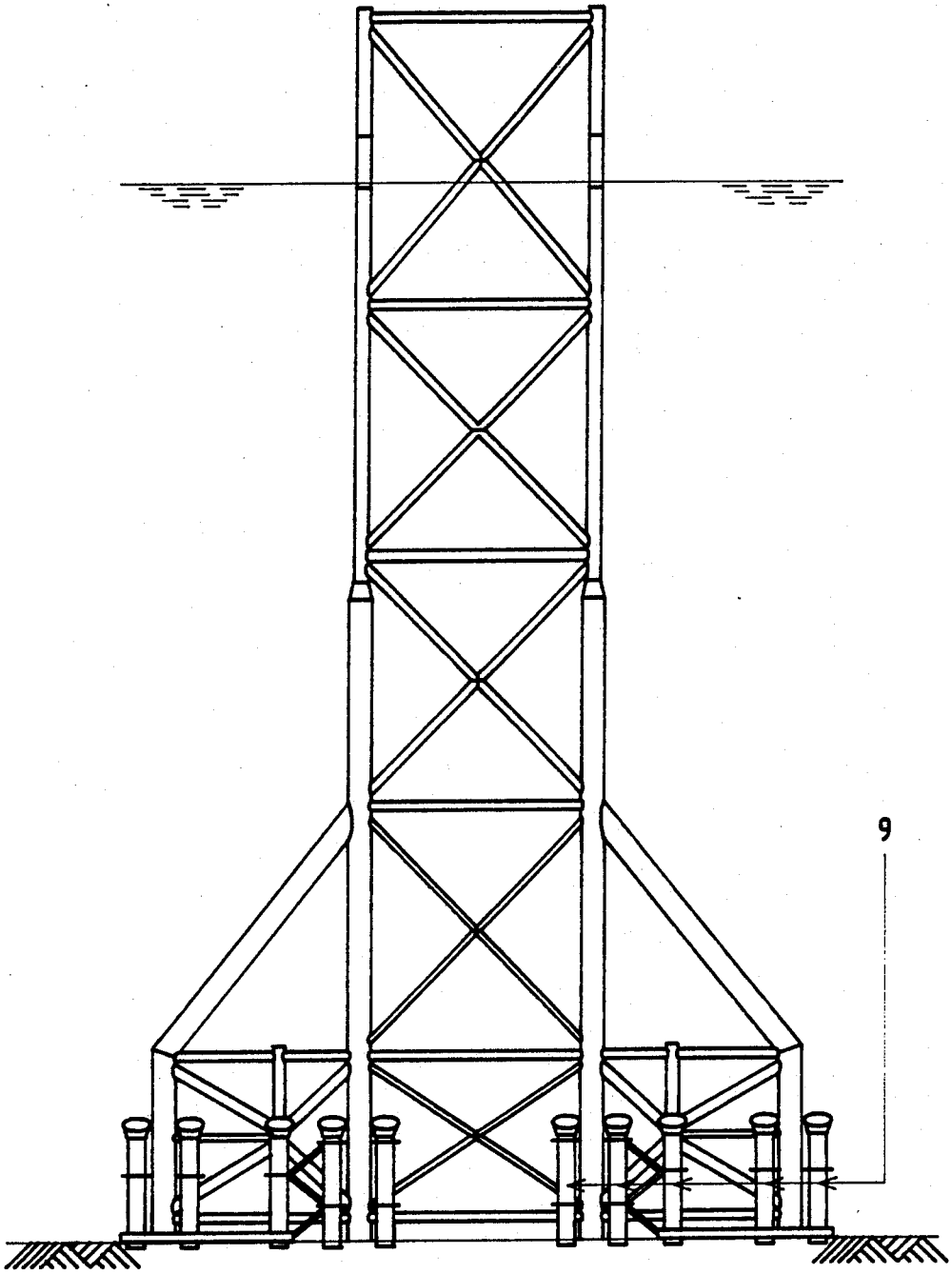
FIG. 5 is an elevational view of the structure, similar to FIG. 2, showing the potential for various pile configurations.
Figure 6:
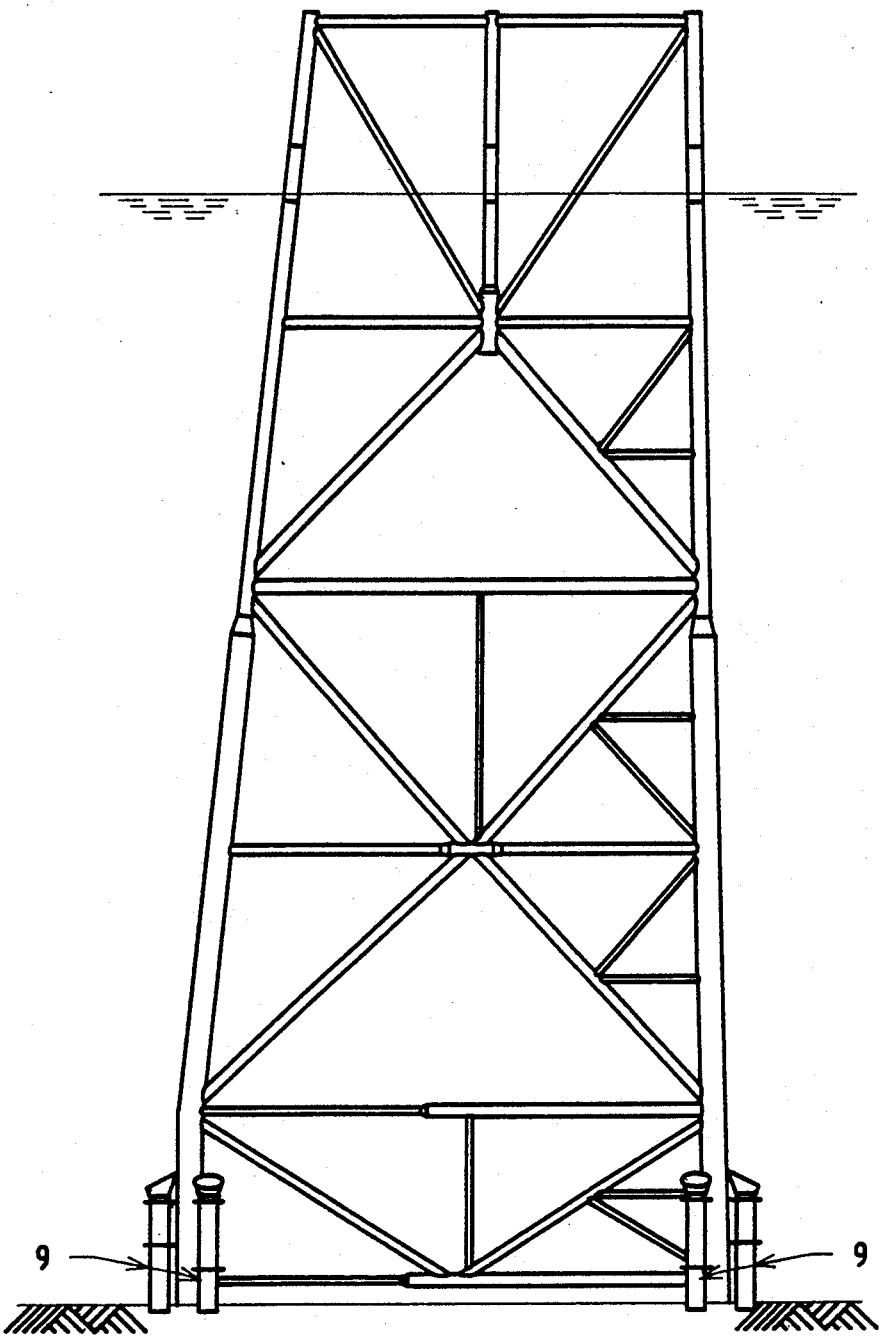
FIG. 6 is an elevational view, similar to FIG. 3, showing potential pile arrangements.

Piles may be attached in any fashion to any leg or intermediate post. A case is illustrated in FIGS. 5 and 6, where piles 9 are attached at all eight legs plus the intermediate posts. The piles are shown vertical, but may be battered.

A specific example of the use of the invention is as follows: A facility is constructed in accordance with FIGS. 1–6, sized and proportioned to carry a topsides payload of 19,000 metric tons, and to resist environmental loads (100 year storms) of a 23 m wave and 60 m/s cyclonic winds. The water depth is 130 m., the structure dimensions for this example are 65 m×80 m spread base and 30 m×48 m at the top, and the platform as a basic structure weight of 12,000 metric tons. The soil conditions reflect very weak material. Twenty piles are necessary to resist the loads. Twenty-eight piles are provided to allow for eight spares in the event of changed requirements during pile installation. The piles are arranged in this example as follows: Four in each corner leg, two in each internal leg and one in each post between legs.

I claim:

1. A lattice framework for an offshore structure capable of supporting a deck above the water for offshore operations such as drilling for oil or gas for exploration or production as well as radar stations and the like where it is desired to maintain a stable platform in a fixed position over the sea bed, said framework including the combination of four upwardly extending main legs oriented in spaced-apart relationship about a central axis, cross brace means connected between the main legs at vertical intervals to form a support lattice therebetween, a spread base connected to the lower portions of the main legs, said spread base including four buttress legs extending from the main legs in downwardly and outwardly inclined directions in planes defined by two pairs of adjacent legs, additional cross brace means connected between the buttress legs and lower portions of the main legs to form another support lattice therebetween, means for supporting a plurality of foundation piles adjacent the lower ends of the main legs and lower ends of the buttress legs, one of the aforesaid pairs of adjacent main legs being oriented parallel to form launch rails on which the structure can be launched from a barge, and strengthening brace means in said framework connected with said two adjacent main legs of the one pair to resist launch loads.

2. A framework as in claim 1 in which said means for supporting the foundation piles orients the longitudinal axes of the piles in either vertical or battered position attached to one or more of said main legs or to one or more of the extremities of the buttress legs.

3. A framework as in claim 1 in which said cross brace means between the main legs and said additional cross brace means between the buttress legs have a stiffness which is predetermined in accordance with the positions at which said piles are supported at the lower ends of said main legs or at the lower ends of said buttress legs so that the loads on the main legs are in a predetermined distribution.

* * * * *